United States Patent [19]

Harris

[11] 4,193,059

[45] Mar. 11, 1980

[54] ATTITUDE INDICATOR COMPARATOR WARNING SYSTEM

[75] Inventor: Richard L. Harris, Oklahoma City, Okla.

[73] Assignee: The United States of America as represented by the Secretary of the Air Force, Washington, D.C.

[21] Appl. No.: 915,708

[22] Filed: Jun. 15, 1978

[51] Int. Cl.[2] ..... G08B 21/00; G08C 19/46

[52] U.S. Cl. ..... 340/27 AT; 33/328; 340/27 R; 340/181; 340/198; 340/315; 340/681; 318/654

[58] Field of Search ..... 340/27 R, 27 NA, 27 AT, 340/181, 198, 315, 681; 33/328, 329, 330; 318/654; 244/177, 194, 196

[56] References Cited

U.S. PATENT DOCUMENTS

| | | | |
|---|---|---|---|
| 2,428,402 | 10/1947 | Winterbottom | 340/315 |
| 2,432,772 | 12/1947 | Lear | 340/315 |
| 2,596,698 | 5/1952 | Laing et al. | 340/198 |
| 2,794,975 | 6/1957 | Sedgfield et al. | 340/198 |
| 2,810,119 | 10/1957 | Brown | 340/27 NA |
| 2,950,460 | 8/1960 | Seifried et al. | 340/27 R |
| 3,094,691 | 6/1963 | Treffeisen | 340/181 |
| 3,534,349 | 10/1970 | Mallinson | 340/198 |
| 3,537,086 | 10/1970 | Andresen | 340/27 R |

*Primary Examiner*—John W. Caldwell, Sr.
*Assistant Examiner*—James J. Groody
*Attorney, Agent, or Firm*—Joseph E. Rusz; Robert Kern Duncan

[57] ABSTRACT

The indications of attitude indicators at two different indicating locations that are indicating the same parameter but actuated from different sources, are monitored for the same indication by electrically interconnecting two transolvers that are mechanically coupled to the respective attitude indicator at each location. A monitor, at one indicating location, furnishes the excitation for the transolver at the other location and by the magnitudes of the sine and cosine outputs of the local transolver furnishes flag indication of any system defects of either indicator at each location.

4 Claims, 3 Drawing Figures

ATTITUDE INDICATOR COMPARATOR WARNING SYSTEM

RIGHTS OF THE GOVERNMENT

The invention described herein may be manufactured and used by or for the Government of the United States for all governmental purposes without the payment of any royalty.

BACKGROUND OF THE INVENTION

The field of the invention is in the instrumentation art and more particularly in the indicator monitoring art.

The need of reliable instrumentation is well known. Various means have been devised over the years to verify if a gage, a pointer, or a meter is indicating a true value. One of the simplest means is the redundancy of multiple systems and indicators. This technique is very space consuming, costly, and complicated. The common state of the art method is to present only a single indication but to compare or monitor this indication electrically with another value indicative of the same parameter but derived through a different system. When a departure from equivalency of the two systems is detected by the monitor an indication such as an audible alarm, a light, or an indicator flag is raised to indicate to the observer that a defect exists in the system with a possible erroneous indication being presented. These redundancy systems as previously stated, are expensive, bulky, complicated and through the additional coupling to the parameter being sensed, increases the possibility of detrimental effects occurring in the operation being sensed. Some prior art instrument flight indicator monitors will give an indication of error for different instrument indications when the monitoring system is functioning, but will not sense a failure in the monitoring system.

The best known prior art is that of U.S. Pat. Nos. 3,439,321 to patentee Sebern; 3,685,034 to patentee Hedrick; 2,603,696 to patentee McEwan; and 3,778,760 to patentee Jayne.

SUMMARY OF THE INVENTION

In a system having sphere attitude indicators displaying roll and pitch at each of two positions, such as pilot and copilot, with indicated values derived separately, the indicated readings of one parameter, such as roll, are compared in a monitor in the indicator at one location and the readings of the other parameter (pitch) are compared in a monitor at the other location. A deviation of a greater than a determined amount between a compared reading of either pitch or roll, or a defect in either the pitch or roll monitoring system will actuate a warning indication at both the pilot's and copilot's positions. This cross-monitoring of sphere position provides failure detection of any part of both attitude indicating systems. Generally the prior art indicator contained monitors effectively detect only failures in the particular indicator.

DESCRIPTION OF THE PREFERRED EMBODIMENTS

Typically the invention will be applied to the pitch and roll sphere indicators at the pilot's and copilot's positions, and such will be described in detail. It is to be understood however that the invention is not intended to be restricted only to such application but will be incorporated in other multiple indicating systems such as Attitude Director Indicators and Flight Director Indicators to provide a warning of a malfunction.

Most large aircraft have two separate attitude indicating systems, each of which consists of an attitude gyroscope with an indicator which frequently includes a remote amplifier to compensate for signal loss between the gyro and the indicator and provide greater indicator drive power. Usually the amplifier is attached to or positioned internally in the indicator. Through a servo loop the indicating sphere in the indicator follows the output of the attitude gyroscope. The voltage amplitude and phase relationship of the power supplied to the two indicators are not necessarily the same, nor do they need to be since the two systems are entirely separate. Cross-monitoring of the sphere position in the two indicators will detect a failure in any component of either system.

Figure 1:
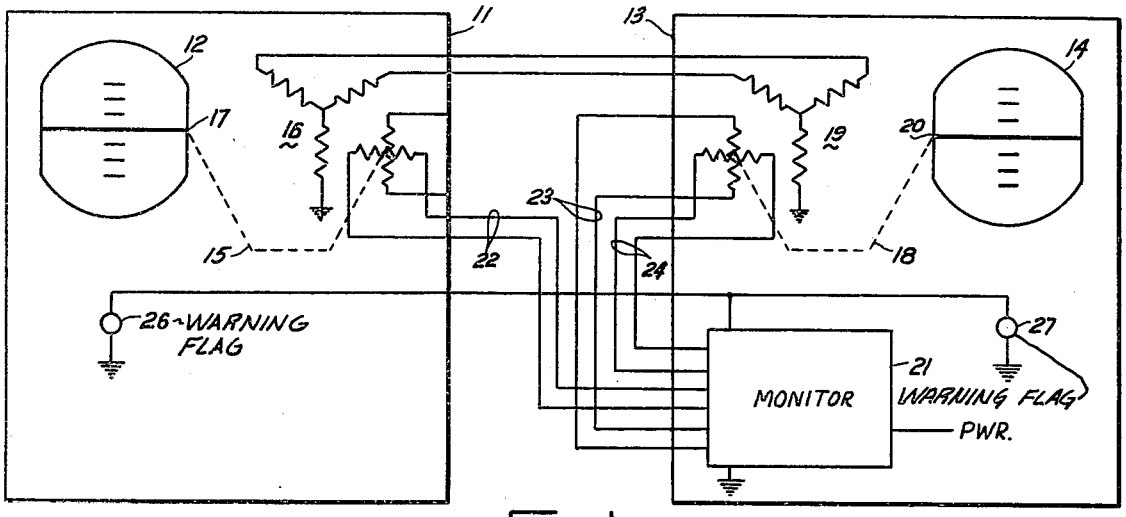
FIG. 1 is a schematic-pictorial representation of a typical embodiment of the invention for monitoring the roll channels of two attitude indicators.
Figure 2:
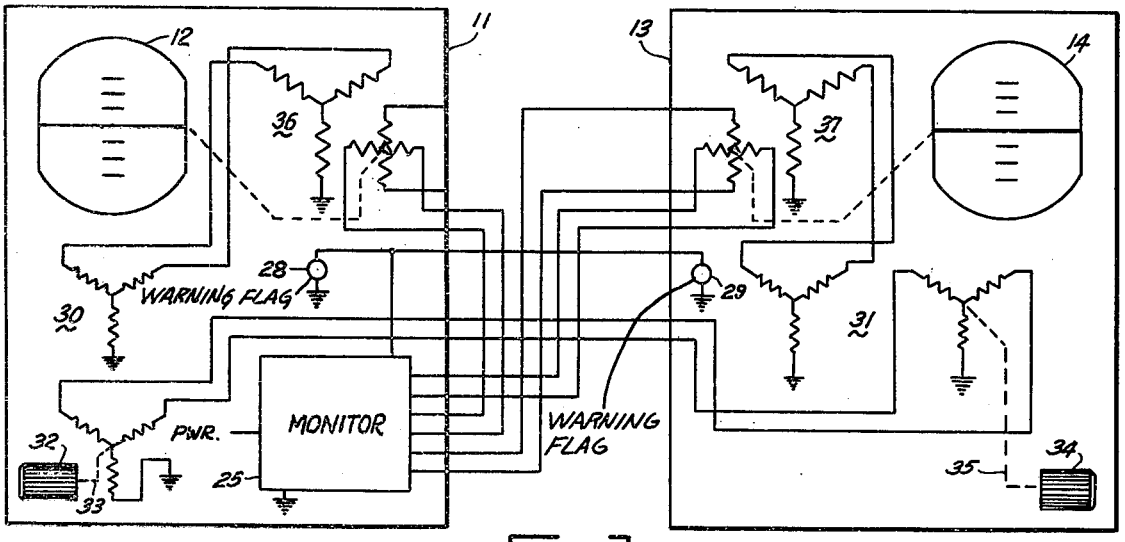
FIG. 2 is a schematic-pictorial representation of a typical embodiment of the invention for monitoring the pitch channels and providing compensation for pitch trim control.

Referring to FIGS. 1 and 2, the conventional pilot's attitude indicator 11 has conventionally actuated pitch and roll indicator sphere 12. Likewise the conventional copilot's attitude indicator 13 has conventionally actuated pitch and roll indicator sphere 14. As previously stated the actuating systems and signals for the pilots indicator are separate from those actuating the copilots indicator, both in pitch and roll. Obviously, since they are in the same airplane, the readings in pitch and roll indicated at the two positions should be substantially the same. If the indications are not the same, it is desirable that the pilot and copilot be alerted so that instead of depending solely on a particular reading, which may be erroneous, the operators may enlist other attitude indicating information to assist them.

Figure 3:
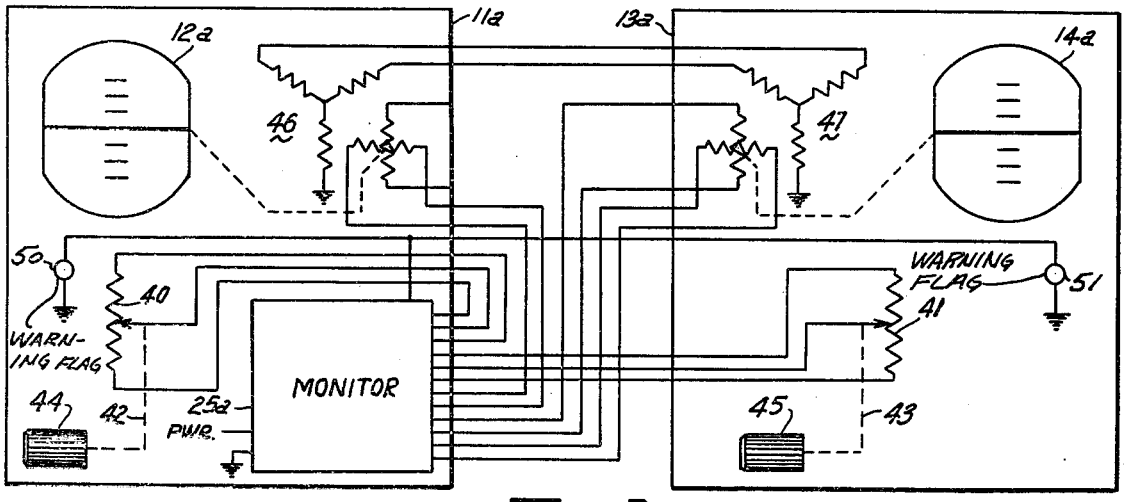
FIG. 3 is a schematic-pictorial representation of a typical embodiment of the invention for monitoring the pitch channels and providing a different means of compensation for pitch trim control.

The pilot's sphere 12 and the copilot's sphere 14 each indicate both pitch and roll. For simplicity the embodiment for monitoring roll is illustrated in FIG. 1 and an embodiment for monitoring pitch is shown in FIG. 2. An alternate embodiment for monitoring pitch is shown in FIG. 3. Generally the attitude spheres are motor driven in both pitch and roll from the signals obtained from the gyroscope. Referring to FIG. 1, the invention comprises conventionally mechanically coupling the shaft 15 connected to the quadrature windings of a conventional transolver 16 to the motor shaft 17 driving the pilot's sphere 12 in roll, and likewise coupling the shaft 18 of a similar transolver 19 to the roll drive 20 of the copilot's sphere. A conventional comparator warning monitor 21, such as a Collins Radio Company type 54W-1, having null and peak monitoring capability with alarm flag drive indication, is used to supply excitation on lines 22 to the pilot's roll position transolver and to monitor the sine 23 and cosine 24 outputs from the transolver 19 coupled to the copilot's roll position drive indicator. It is to be noted that the quadrature winding of the rotor of the transolver receiving the excitation is unconnected. The pitch positions at the two locations are similarly monitored by monitor 25 of FIG. 2, or in the alternate pitch monitoring embodiment shown in FIG. 3 by monitor 25*a*.

It is generally desirable to position the monitors such that a monitor in one indicator monitors sphere position in pitch in both indicators and a monitor in the other indicator monitors the sphere position in roll in both indicators, thus the two attitude indicators are interchangeable. Warning is conventionally implemented by use of existing warning flags 26 and 27 on the faces of the indicators. The three-wire stator output from the excited transolver 16 is interconnected directly to the respective connections of the transolver 19 in the other indicator. As long as the two indicators track each other in roll the sine output on line 23 is at a null and the cosine output on line 24 is high from the transolver 19 to the roll monitor 21. Likewise, the same general conditions apply to the pitch monitoring systems of FIGS. 2 and 3.

Many attitude indicators, particularly those used on military aircraft, have a pitch trim capability. This provides the capability of adjusting the horizon to coincide with the aircraft symbol, indicating level flight regardless of the pitch attitude of the aircraft. If in a particular application of the invention to an aircraft that does not have pitch trim capability, the pitch indicator monitoring system is identical to the roll monitoring system as shown in FIG. 1 except, of course, connected to the pitch drive motors. In aircraft having pitch trim capability the pitch trim in the two indicators will not necessarily be adjusted the same, therefore any difference must be compensated for when the sphere pitch position between the two indicators is compared. FIG. 2 illustrates an embodiment using conventional differential syncros 30 and 31 mechanically coupled 33 and 35 to the same pitch trim knobs 32 and 34 that adjust sphere pitch trim position in the original indicator equipment. Note, that stators of transolvers 36 and 37 are not directly connected as in FIG. 1, but are interconnected through the differential syncros 30 and 31 that have their stator winding connected to the stator windings of their respective transolvers 36 and 37.

The embodiment illustrated in FIG. 3 provides pitch trim adjustment through the settings of potentiometers 40 and 41 which are mechanically coupled 42 and 43 to the original pitch trim knobs 44 and 45. Some currently available monitors such as illustrated at 25*a* have provision for electrical trim of the inputs being monitored and compared. In embodiments of the invention utilizing these types of monitors the stators of the transolvers 46 and 47 are connected as in the embodiment illustrated in FIG. 1. FIG. 3 includes warning flags 50 and 51.

In typical operation of embodiments of the invention the attitude warning flags 26, 27, and 28, 29 appear in both the pilots indicator 11 and the copilot's indicator 13 when power is lost to the comparator circuitry as indicated by a low in the cosine voltage from the transolver. Thus, if the voltage across line 24 drops to substantially zero or a predetermined low value, flags 26 and 27 are activated indicating to both the pilot and the copilot to be suspect of the roll indication of the sphere in their indicator. The same situation in the pitch system will be indicated by flags 28 and 29.

Typically, conventional monitors 21, 25, and 25*a* are conventionally set so that when the sphere position between the pilot's and copilot's indicators differ more than 6±1 degree for more than one second, the roll flags are actuated, and when the compensated for pitch trim position indications differ more than 6±1 degree in pitch for more than one second the pitch flags 28 and 29 are actuated. These values are sensed by respective monitors as voltage values in departures from the null in the sine outputs from the transolvers.

I claim:

1. An attitude indicator comparator warning system comprising:

a. a first attitude indicator indicating an attitude parameter, and having a motor drive actuated from a first sensing system;

b. a second attitude indicator indicating the same attitude parameter, and having a motor drive actuated from a second sensing system;

c. a first transolver having a stator winding and a rotor winding:

d. a second transolver having a stator winding and a rotor winding;

e. means for coupling the said rotor of the first transolver to the said motor drive in the said first attitude indicator;

f. means for coupling the said rotor of the second transolver to the said motor drive of the said second attitude indicator;

g. means for interconnecting the said stator winding of the first transolver with the said stator winding of the second transolver; and h. a comparator warning monitor providing excitation to the rotor of the said first transolver and cooperating with the rotor of the said second transolver and providing a flag output responsive to the output from the rotor of the said second transolver.

2. An attitude indicator comparator warning system for a first attitude indicator and a second attitude indicator, the said first and second attitude indicators indicating the same parameter and having indicator drive motors energized from separate sources and with each indicator having an electrically actuated flag indicator, the said warning system comprising:

a. a first transolver coupled to the said motor drive of the said first attitude indicator and having an electrical excitation input and an electrical output;

b. a second transolver coupled to the said motor drive of the said second attitude indicator and having an electrical input and a sine and cosine electrical output;

c. means for interconnecting the said electrical output of the first transolver with the electrical input of the said second transolver;

d. a comparator warning monitor having an excitation output, a sine input, a cosine input, and a flag excitation output;

e. means for connecting the said excitation output from the said monitor to the said excitation input of the said first transolver;

f. means for connecting the sine output from the said second transolver to the said sine input of the said monitor, and connecting the said cosine output from the said second transolver to the said cosine input of the said monitor; and g. means for connecting the said flag excitation output of the said monitor to the said electrically actuated flag indicator of both the said first and said second attitude indicators whereby the said flag indication is responsive to the said sine output and the said cosine output from the said second transolver.

3. The warning system as claimed in claim 2 wherein the said first and second attitude indicators provide a trim adjustment and the said means for interconnecting the said electrical output of the said first transolver with the said electrical input of the said second transolver includes a first differential syncro electrically connected to the said first transolver output and a second differential syncro electrically connected to the said input of the second transolver and the said first differential syncro mechanically cooperating with the said trim adjustment of the first indicator and the said second differential syncro mechanically cooperating with the said trim adjustment of the second indicator, whereby differences in trim adjustment in the said first indicator and the said second indicator are compensated.

4. The warning system as claimed in claim 2 wherein the said first and second attitude indicators provide a trim adjustment and the said monitor provides a first trim adjustment input and a second trim adjustment input, the said attitude warning system including a first potentiometer cooperating mechanically with the first attitude indicator trim adjustment and electrically connected to the first trim adjustment input of the said monitor and a second potentiometer mechanically cooperating with the second attitude indicator trim adjustment and electrically connected to the second trim adjustment input of the said monitor, whereby differences in trim adjustment in the said first and second indicators are compensated.

* * * * *